US005270282A

United States Patent [19]

Hirst et al.

[11] Patent Number: 5,270,282

[45] Date of Patent: Dec. 14, 1993

[54] RECEIVER SHEET

[75] Inventors: Paul R. Hirst, Saltburn by Sea; John Francis, Yarm, both of England

[73] Assignee: Imperial Chemical Industries PLC, London, England

[21] Appl. No.: 719,310

[22] Filed: Jun. 24, 1991

[30] Foreign Application Priority Data

Jun. 22, 1990 [GB] United Kingdom ..... 9013918

[51] Int. Cl.[5] ..... B41M 5/035; B41M 5/38

[52] U.S. Cl. ..... 503/227; 428/195; 428/206; 428/323; 428/330; 428/913; 428/914

[58] Field of Search ..... 8/471; 428/195, 323, 428/913, 914, 206, 330

[56] References Cited

U.S. PATENT DOCUMENTS 4,720,480 1/1988 Ito et al. ..... 503/227

FOREIGN PATENT DOCUMENTS 0349141 1/1990 European Pat. Off. ..... 503/227
0351075 1/1990 European Pat. Off. ..... 503/227
0351971 1/1990 European Pat. Off. ..... 503/227

*Primary Examiner*—B. Hamilton Hess
*Attorney, Agent, or Firm*—Cushman, Darby & Cushman

[57] ABSTRACT

A thermal transfer printing receiver sheet for use in association with a compatible donor sheet. The receiver sheet comprises in order (i) a supporting substrate comprising a layer of a synthetic polymer having a deformation index, at a temperature of 200° C. and under a pressure of 2 megapascals, of at least 4.5%, (ii) a polymeric intermediate layer having a Transmission Optical Density/film thickness (in mm) ratio of from 7.5 to 17.5, and (iii) a dye-receptive receiving layer to receive a dye thermally transferred from the donor sheet.

8 Claims, 1 Drawing Sheet

RECEIVER SHEET

BACKGROUND OF THE INVENTION (a) Technical Field of Invention

This invention relates to thermal transfer printing and, in particular, to a thermal transfer printing receiver sheet for use with an associated donor sheet.

(b) Background of the Art

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, having on a surface thereof a dye-receptive, polymeric receiving layer. When an assembly, comprising a donor and a receiver sheet positioned with the respective transfer and receiving layers in contact, is selectively heated in a patterned area derived, for example-from an information signal, such as a television signal, dye is transferred from the donor sheet to the dye-receptive layer of the receiver sheet to form therein a monochrome image of the specified pattern. By repeating the process with different monochrome dyes, usually cyan, magenta and yellow, a full coloured image is produced on the receiver sheet. Image production, therefore depends on dye diffusion by thermal transfer.

To facilitate separation of the imaged sheet from the heated assembly, at least one of the transfer layer and receiving layer may be associated with a release medium, such as a silicone oil.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element or pixcel (electronically controlled, if desired). A problem associated with such a contact print-head is the deformation of the receiver sheet resulting from pressure of the respective elements on the heated, softened assembly. This deformation manifests itself as a reduction in the surface gloss of the receiver sheet, and is particularly significant in receiver sheets the surface of which is initially smooth and glossy, i.e. of the kind which is in demand in the production of high quality art-work. A further problem associated with pressure deformation is the phenomenon of "strike-through" in which an impression of the image is observed on the rear surface of the receiver sheet, i.e. the free surface of the substrate remote from the receiving layer.

Available TTP print equipment has been observed to yield defective imaged receiver sheets comprising inadequately printed spots of relatively low optical density which detract from the appearance and acceptability of the resultant print. There are basically two types of printing flaws. The first type of printing flaw is due to gaps appearing between the printed image of adjacent pixcels and results in the appearance of regularly spaced flaws. The regularly spaced flaws, conveniently referred to as micro-dots, are believed to result from poor conformation of the donor sheet to the print-head at the time of printing. The second type of printing flaw, conveniently referred to as drop-outs, are irregularly spaced and are believed to result from imperfections in the surface of the receiver sheet. There is a need to eliminate both types of the aforementioned printing flaws and to provide a TTP receiver sheet which exhibits high gloss, opacity and whiteness.

(c) The Prior Art

Various receiver sheets have been proposed for use in TTP processes. For example, EP-A-0194106 discloses a heat transferable sheet having a substrate and an image-receiving layer thereon, with an intermediate layer between the substrate and receiving layer.

The intermediate layer serves as a cushion between the substrate and receiving layer and consists mainly of a resin, such as a polyurethane, polyacrylate or polyester, having a 100% modulus of 100 kg/cm$^2$ or lower, as defined by JIS-K-6301. Inadequate adhesion between the donor and receiver sheets is observed if the intermediate layer is formed from a resin of higher modulus.

U.S. Pat. No. 4734397 seeks to avoid the production of irregular images resulting from entrapment of dust and non-uniformity of the dye-receptive layer by providing a receiver sheet comprising a compression layer between a substrate and a dye-receptive layer. The compression layer, which preferably comprises a resin, such as polymethylmethacrylate, an acrylonitrile-styrene copolymer, a modified polybutylene-terephthalate or a polyurethane, is applied to the substrate as a coating, for example - as a solution in a mixed solvent comprising dichloromethane and trichloroethylene, at a coverage of at least 2.0 g/m$^2$ and has an elasticity of less than 500% elongation at break. Preferably, the compression layer exhibits a compression modulus of less than 350 megapascals.

European patent application EP-A-292109 describes the production of high quality prints by the use of opaque molecularly oriented thermoplastic films as a substrate for a receiver sheet. Such films generally contain both voids and particulate solids, for example, finely divided inorganic materials and polymeric materials, for giving the opacity and whiteness.

We have now devised a receiver sheet for use in a TTP process which exhibits high gloss, opacity and whiteness, and overcomes or substantially reduces the aforementioned printing flaw problems.

SUMMARY OF THE INVENTION

Accordingly, the present invention provides a thermal transfer printing receiver sheet for use in association with a compatible donor sheet, the receiver sheet comprising a supporting substrate having, on a surface thereof, a polymeric intermediate layer having on the remote surface thereof, a dye-receptive receiving layer to receive a dye thermally transferred from the donor sheet, wherein the substrate comprises a layer of a synthetic polymer having a deformation index, at a temperature of 200° C. and under a pressure of 2 megapascals, of at least 4.5%, and the intermediate layer is opaque.

The invention also provides a method of producing a thermal transfer printing receiver sheet for use in association with a compatible donor sheet, comprising forming a supporting substrate and providing on a surface thereof, a polymeric intermediate layer having on the remote surface thereof, a dye-receptive receiving layer to receive a dye thermally transferred from the donor sheet, wherein the substrate comprises a layer of a synthetic polymer having a deformation index, at a temperature of 200° C. and under a pressure of 2 megapascals, of at least 4.5%, and the intermediate layer is opaque.

DETAILED DESCRIPTION AND PREFERRED EMBODIMENTS OF THE INVENTION

In the context of the invention the following terms are to be understood as having the meanings hereto assigned:

- sheet: includes not only a single, individual sheet, but also a continuous web or ribbon-like structure capable of being sub-divided into a plurality of individual sheets.
- compatible: in relation to a donor sheet, indicates that the donor sheet is impregnated with a dyestuff which is capable of migrating, under the influence of heat, into, and forming an image in, the receiving layer of a receiver sheet placed in contact therewith.
- voided: indicates that the intermediate layer of the receiver sheet comprises a cellular structure containing at least a proportion of discrete, closed cells.
- film: is a self-supporting structure capable of independent existence in the absence of a supporting base.
- antistatic: means that a receiver sheet treated by the application of an antistatic layer exhibits a reduced tendency, relative to an untreated sheet, to accumulate static electricity at the treated surface.
- deformation index: is the deformation, expressed as a percentage of the original thickness of the substrate sheet, observed when the substrate sheet is subjected, at a temperature of 200° C., to a pressure of 2 megapascals applied normal to the plane of the sheet by the hereinafter described test procedure.

The aforementioned test procedure is designed to provide conditions approximately equivalent to those encountered by a receiver sheet at the thermal printhead during a TTP operation. The test equipment comprises a thermomechanical analyser, Perkin Elmer, type TMA7, with a test probe having a surface area of 0.785 $mm^2$.

A sample of the substrate, for example—a biaxially oriented polyethylene terephthalate film of 125 μm thickness, is introduced in a sample holder into the TMA7 furnace and allowed to equilibrate at the selected temperature of 200° C. The probe is loaded to apply a pressure of 0.125 megapascals normal to the planar surface of the hot film sample and the deformation is observed to be zero. The load on the probe is then increased whereby a pressure of 2 megapascals is applied to the sample. The observed displacement of the probe under the increased load is recorded and expressed as a percentage of the thickness of the undeformed hot sample (under 0.125 megapascals pressure). That percentage is the Deformation Index (DI) of the tested substrate material.

The substrate and/or intermediate layer of a receiver sheet according to the invention may be formed from any synthetic, film-forming, polymeric material. Suitable thermoplastics, synthetic, materials include a homopolymer or a copolymer of a 1-olefine, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, e.g. terephthalic acid, isophthalic acid, phthalic acid, 2,5-, 2,6- or 2,7- naphthalenedicarboxylic acid, succinic acid, sebacic acid, adipic acid, azelaic acid, 4,4'- diphenyldicarboxylic acid, hexahydro-terephthalic acid or 1,2-bis-p-carboxyphenoxyethane (optionally with a monocarboxylic acid, such as pivalic acid) with one or more glycols, particularly an aliphatic glycol, e.g. ethylene glycol, 1,3-propanediol, 1,4-butanediol, neopentyl glycol and 1,4-cyclohexanedimethanol. A polyethylene terephthalate film is particularly preferred, especially such a film which has been biaxially oriented by sequential stretching in two mutually perpendicular directions, typically at a temperature in the range 70° to 125° C., and preferably heat set, typically at a temperature in the range 150° to 250° C., for example—as described in British patent 838,708.

The substrate and/or intermediate layer may also comprise a polyarylether or thio analogue thereof, particularly a polyaryletherketone, polyarylethersulphone, polyaryletheretherketone, polyaryletherethersulphone, or a copolymer or thioanalogue thereof. Examples of these polymers are disclosed in EP-A-1879, EP-A-184458 and US-A-4008203, particularly suitable materials being those sold by ICI PLC under the Registered Trade Mark STABAR. Blends of these polymers may also be employed.

Suitable thermoset resin substrate and/or intermediate layer materials include addition—polymerisation resins—such as acrylics, vinyls, bis-maleimides and unsaturated polyesters, formaldehyde condensate resins—such as condensates with urea, melamine or phenols, cyanate resins, functionalised polyesters, polyamides or polyimides.

A film substrate for a receiver sheet according to the invention exhibits a Deformation Index (DI), as hereinbefore defined, of at least 4.5%. Elastic recovery of the deformed substrate is of importance in the production of TTP images of sharp definition and good contrast, and a preferred substrate exhibits a DI of not greater than about 50%. Preferably, therefore, a receiver substrate exhibits a DI within a range of from 4.5 to 50%, and especially from 10 to 30%. Particularly desirable performance is observed with a DI of from 15 to 25%.

The required DI is conveniently achieved by incorporation into the substrate polymer of an effective amount of a dispersible polymeric softening agent. For example, the DI of a polyethylene terephthalate substrate may be adjusted to the required value by incorporation therein of an olefin polymer, such as a low or high density homopolymer, particularly polyethylene, polypropylene or poly-4-methylpentene-1, an olefin copolymer, particularly an ethylene-propylene copolymer, or a mixture of two or more thereof. Random, block or graft copolymers may be employed.

Dispersibility of the aforementioned olefin polymer in a polyethylene terephthalate substrate may be inadequate to confer the desired characteristics. Preferably, therefore a dispersing agent is incorporated together with the olefin polymer softening agent. The dispersing agent conveniently comprises a carboxylated polyolefin, particularly a carboxylated polyethylene.

The carboxylated polyolefin is conveniently prepared by the oxidation of an olefin homopolymer (preferably an ethylene homopolymer) to introduce carboxyl groups onto the polyolefin chain. Alternatively the carboxylated polyolefin may be prepared by copolymerising an olefin (preferably ethylene) with an olefinically unsaturated acid or anhydride, such as acrylic acid, maleic acid or maleic anhydride. The carboxylated polyolefin may, if desired, be partially neutralised. Suitable carboxylated polyolefins include those having a Brookfield Viscosity (140° C.) in the range 150–100000 cps (preferably 150–50000 cps) and an Acid Number in the range 5–200 mg KOH/G (preferably 5–50 mg KOH/g), the Acid Number being the number of mg of KOH required to neutralise 1 g of polymer.

The amount of dispersing agent may be selected to provide the required degree of dispersibility, but conveniently is within a range of from 0.05 to 50%, preferably from 0.5 to 20%, by weight of the olefin polymer softening agent.

An alternative polymeric softening agent, which may not require the presence of a polymeric dispersing agent, comprises a polymeric elastomer. Suitable polymeric elastomers include polyester elastomers such as a block copolymer of n-butyl terephthalate with tetramethylene glycol or a block copolymer of n-butyl terephthalate hard segment with an ethylene oxide-propylene oxide soft segment.

The amount of incorporated polymeric softening agent is conveniently within a range of from 0.5 to 50%, particularly from 1.0 to 25%, by weight of the total substrate material (substrate polymer plus softening agent, and dispersing agent, if employed).

The polymeric components of the substrate compositions may be mixed together in conventional manner. For example, the components may be mixed by tumble or dry blending or by compounding in an extruder, followed by cooling and, usually, comminution into granules or chips.

As noted the polymeric intermediate layer is opaque. The intermediate layer is conveniently rendered opaque by incorporation into the synthetic polymer of an effective amount of an opacifying agent. However, in a preferred embodiment of the invention the intermediate layer is voided, as hereinbefore defined. It is therefore preferred to incorporate into the polymer an effective amount of an agent which is capable of generating an opaque, voided intermediate layer structure. Suitable voiding agents, which also confer opacity, include an incompatible resin filler, a particulate inorganic filler or a mixture of two or more such fillers.

By an "incompatible resin" is meant a resin which either does not melt, or which is substantially immiscible with the polymer, at the highest temperature encountered during extrusion and fabrication of the layer. Such resins include polyamides and olefin polymers, particularly a homo- or co-polymer of a mono-alpha-olefin containing up to 6 carbon atoms in its molecule, for incorporation into polyester films, or polyesters of the kind hereinbefore described for incorporation into polyolefin films.

Particulate inorganic fillers suitable for generating an opaque, voided intermediate layer include conventional inorganic pigments and fillers, and particularly metal or metalloid oxides, such as alumina, silica and titania, and alkaline metal salts, such as the carbonates and sulphates of calcium and barium. Barium sulphate is a particularly preferred filler which also functions as a voiding agent.

Non-voiding particulate inorganic fillers may also be added to the film-forming polymeric intermediate layer.

Suitable voiding and/or non-voiding fillers may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant coupling agent or other modifier to promote or alter the degree to which the filler is compatible with the substrate polymer.

Production of an intermediate layer having satisfactory degrees of opacity, voiding and whiteness requires that the filler should be finely-divided, and the average particle size thereof is desirably from 0.1 to 10 μm provided that the actual particle size of 99.9% by number of the particles does not exceed 30 μm. Preferably, the filler has an average particle size of from 0.1 to 10 μm, and particularly preferably from 0.2 to 0.75 μm. Decreasing the particle size improves the gloss of the substrate.

Particle sizes may be measured by electron microscope, coulter counter or sedimentation analysis and the average particle size may be determined by plotting a cumulative distribution curve representing the percentage of particles below chosen particle sizes.

It is preferred that none of the filler particles incorporated into the intermediate layer according to this invention should have an actual particle size exceeding 30 μm. Particles exceeding such a size may be removed by sieving processes which are known in the art. However, sieving operations are not always totally successful in eliminating all particles greater than a chosen size. In practice, therefore, the size of 99.9% by number of the particles should not exceed 30 μm. Most preferably the size of 99.9% of the particles should not exceed 20 μm.

Incorporation of the opacifying/voiding agent into the intermediate layer polymer may be effected by conventional techniques—for example, by mixing with the monomeric reactants from which the polymer is derived, or by dry blending with the polymer in granular or chip form prior to formation of a film therefrom.

The amount of filler, particularly of barium sulphate, incorporated into the intermediate layer polymer desirably should be not less than 5% nor exceed 50% by weight, based on the weight of the polymer. Particularly satisfactory levels of opacity and gloss are achieved when the concentration of filler is from about 8 to 30%, and especially from 15 to 20%, by weight, based on the weight of the intermediate layer polymer.

The aforementioned additives for incorporation into the intermediate layer may also be incorporated into the substrate layer with the proviso that the resulting layer exhibits a deformation index within the preferred range. In a preferred embodiment of the invention the opacity of the receiver sheet is further increased by incorporation into the film forming polymer of the substrate layer of a particulate inorganic filler (which may or may not form voids), especially titanium dioxide, particularly when the substrate comprises an incompatible resin.

Other additives, generally in relatively small quantities, may optionally be incorporated into the film substrate and/or intermediate layer. For example, china clay may be incorporated in amounts of up to 25% to promote voiding, optical brighteners in amounts up to 1500 parts per million to promote whiteness, and dyestuffs in amounts of up to 10 parts per million to modify colour, the specified concentrations being by weight, based on the weight of the substrate and/or intermediate layer polymer(s).

Thickness of the substrate and/or intermediate layer may vary depending on the envisaged application of the receiver sheet but, in general, the substrate will not exceed 250 μm, and will preferably be in a range from 50 to 190 μm. The thickness of the intermediate layer will preferably not exceed 50 μm, more preferably in a range from 2 to 50 μm, particularly from 3 to 30 μm, and especially from 3 to 10 μm. Receiver sheets having substrate layers of different deformation indexes will have different optimal ranges for intermediate layer thickness.

The receiver sheet according to the invention can have a second intermediate layer on the rear surface of the substrate, remote from the receiver layer, in order to increase still further the opacity of the receiver sheet. The thickness of the second intermediate layer will generally not exceed 100 μm, and will preferably be in a range from 3 to 50 μm, particularly from 10 to 50 μm. The thicknesses of the first and second intermediate layers may be the same or different, depending upon the particular application.

A film substrate and/or intermediate layer of a receiver sheet according to the invention may be uniaxially oriented, but is preferably biaxially oriented by drawing in two mutually perpendicular directions in the plane of the film to achieve a satisfactory combination of mechanical and physical properties. Formation of the film(s) may be effected by any process known in the art for producing an oriented polymeric film—for example, a tubular or flat film process.

In a tubular process simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process a film-forming polymer is extruded through a slot die and rapidly quenched upon a chilled casting drum to ensure that the polymer is quenched to the amorphous state. Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, i.e. the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer, for example—a polyester is usually stretched so that the dimension of the oriented polyester film is from 2.5 to 4.5 times its original dimension in the, or each direction of stretching.

A stretched film may be, and preferably is, dimensionally stabilised by heat-setting under dimensional restraint at a temperature above the glass transition temperature of the film-forming polymer but below the melting temperature thereof, to induce crystallisation of the polymer.

Formation of an intermediate layer on the substrate layer may be effected by conventional techniques—for example, by laminating together a preformed intermediate layer and preformed substrate layer, or by casting the intermediate layer polymer onto a preformed substrate layer or vice versa. Conveniently, however, formation of a composite sheet (substrate and intermediate layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A receiver sheet having a substrate and intermediate layer of the kind hereinbefore described offers numerous advantages including (1) a degree of whiteness and opacity essential in the production of prints having the intensity, contrast and feel of high quality art-work, (2) a degree of rigidity and stiffness contributing to improved resistance to surface deformation and image strike-through associated with contact with the print-head and (3) a degree of stability, both thermal and chemical, conferring dimensional stability and curl-resistance.

When TTP is effected directly onto the surface of an intermediate layer of the kind hereinbefore described, the optical density of the developed image tends to be low and the quality of the resultant print is generally inferior. A receiving layer is therefore required on at least one surface of the intermediate layer, and desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque/voided polymer intermediate and/or substrate layer of the kind herein described, a surprising and significant improvement in resistance to surface deformation is achieved, without significantly detracting from the optical density of the transferred image.

A dye-receptive polymer for use in the receiving layer, and offering adequate adhesion to the intermediate layer, suitably comprises a polyester resin, particularly a copolyester resin derived from one or more dibasic aromatic carboxylic acids, such as terephthalic acid, isophthalic acid and hexahydroterephthalic acid, and one or more glycols, such as ethylene glycol, diethylene glycol, triethylene glycol, butylene glycol and neopentyl glycol. Typical copolyesters which provide satisfactory dye-receptivity and deformation resistance are those of ethylene terephthalate and ethylene isophthalate, especially in the molar ratios of from 50 to 90 mole % ethylene terephthalate and correspondingly from 50 to 10 mole % ethylene isophthlate. Preferred copolyesters comprise from 65 to 85 mole % ethylene terephthalate and from 35 to 15 mole % ethylene isophthalate, especially a copolyester of about 65 mole % ethylene terephthalate and about 35 mole % ethylene isophthalate.

Formation of a receiving layer on the intermediate layer may be effected by conventional techniques—for example, by casting the polymer onto a preformed intermediate layer or onto a preformed intermediate/substrate layer composite sheet. Conveniently, however, formation of a receiver sheet (substrate, intermediate and receiving layer) is effected by the aformentioned coextrusion technique.

A coextruded sheet is preferably stretched to effect molecular orientation of the substrate and intermediate layer, and preferably heat-set, as hereinbefore described. Generally, the conditions applied for stretching the substrate and intermediate layer will induce partial crystallisation of the receiving polymer and it is therefore preferred to heat set under dimensional restraint at a temperature selected to develop the desired morphology of the receiving layer. Thus, by effecting heat-setting at a temperature below the crystalline melting temperature of the receiving polymer and permitting or causing the composite to cool, the receiving polymer will remain essentially crystalline. However, by heat-setting at a temperature greater than the crystalline melting temperature of the receiving polymer, the latter will be rendered essentially amorphous. Heat-setting of a receiver sheet comprising a polyester substrate, a polyester intermediate layer and a copolyester receiving layer is conveniently effected at a temperature within a range of from 175° to 200° C. to yield a substantially crystalline receiving layer, or from 200° to 250° C. to yield an essentially amorphous receiving layer.

If desired, a receiver sheet according to the invention may be provided with a backing layer on a surface of the substrate remote from the receiving layer, the backing layer comprising a polymeric resin binder and a non-film-forming inert particulate material of mean particle size from 5 to 250 nm. The backing layer thus includes an effective amount of a particulate material to improve the slip, antiblocking and general handling characteristics of the sheet. Such a slip agent may comprise any particulate material which does not film-form during film processing subsequent to formation of the backing layer, for example—an inorganic material such as silica, alumina, china clay and calcium carbonate, or an organic polymer having a high glass transition temperature ($Tg > 75°$ C.), for example—polymethyl methacrylate or polystyrene. The preferred slip agent is silica which is preferably employed as a colloidal sol, although a colloidal alumina sol is also suitable. A mixture of two or more particulate slip agents may be employed, if desired.

If desired, a receiver sheet according to the invention may additionally comprise an antistatic layer. Such an antistatic layer is conveniently provided on a surface of the substrate remote from the receiving layer, or, if a backing layer is employed, on the free surface of the backing layer remote from the receiving layer. Although a conventional antistatic agent may be employed, a polymeric antistat is preferred. A particularly suitable polymeric antistat is that described in our copending British patent application No 8815632.8 the disclosure of which is incorporated herein by reference, the antistat comprising (a) a polychlorohydrin ether of an ethoxylated hydroxyamine and (b) a polyglycol diamine, the total alkali metal content of components (a) and (b) not exceeding 0.5% of the combined weight of (a) and (b).

In a preferred embodiment of the invention a receiver sheet is rendered resistant to ultra violet (UV) radiation by incorporation of a UV stabiliser. Although the stabiliser may be present in any of the layers of the receiver sheet, it is preferably present in the receiving layer. The stabiliser may comprise an independent additive or, preferably, a copolymerised residue in the chain of the receiving polymer. In particular, when the receiving polymer is a polyester, the polymer chain conveniently comprises a copolymerised esterification residue of an aromatic carbonyl stabiliser. Suitably, such esterification residues comprise the residue of a di(hydroxyalkoxy)coumarin—as disclosed in European Patent Publication EP-A-31202, the residue of a 2-hydroxy- di(hydroxyalkoxy)benzophenone—as disclosed in EP-A-31203, the residue of a bis(hydroxyalkoxy)xanth-9-one - as disclosed in EP-A-6686, and, particularly preferably, a residue of a hydroxy-bis(hydroxyalkoxy)-xanth-9-one—as disclosed in EP-A-76582. The alkoxy groups in the aforementioned stabilisers conveniently contain from 1 to 10 and preferably from 2 to 4 carbon atoms, for example—an ethoxy group. The content of esterification residue is conveniently from 0.01 to 30%, and preferably from 0.05 to 10%, by weight of the total receiving polymer. A particularly preferred residue is a residue of a 1-hydroxy-3, 6-bis(hydroxyalkoxy)xanth-9-one.

A receiver sheet in accordance with the invention may, if desired, comprise a release medium present either within the receiving layer or, preferably as a discrete layer on at least part of the exposed surface of the receiving layer remote from the substrate.

The release medium, if employed, should be permeable to the dye transferred from the donor sheet, and comprises a release agent—for example, of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. An organopolysiloxane resin is particularly suitable for application as a discrete layer on at least part of the exposed surface of the receiving layer.

The release medium may, if desired, additionally comprise a particulate adjuvant. Suitably, the adjuvant comprises an organic or an inorganic particulate material having an average particle size not exceeding 0.75 μm and being thermally stable at the temperatures encountered during the TTP operation.

Brief Description Of The Drawings

The invention is illustrated by reference to the accompanying drawings in which.

Figure 1:
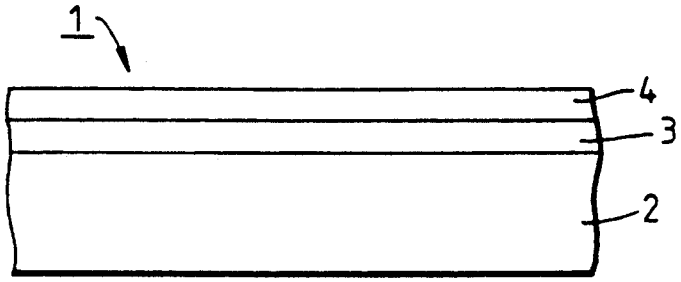
FIG. 1 is a schematic elevation (not to scale) of a portion of a TTP receiver sheet 1 comprising a polymeric supporting substrate 2 comprising a layer of a synthetic polymer having a deformation index, at a temperature of 200° C. and under a pressure of 2 megapascals, of at least 4.5%, said substrate having, on a first surface thereof a polymeric intermediate layer 3 which is opaque, said intermediate layer having, on the remote surface thereof, a dye-receptive receiving layer 4.
Figure 2:
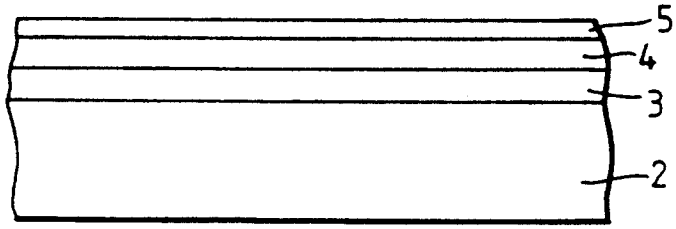
FIG. 2 is a similar, fragmentary schematic elevation in which the receiver sheet comprises an independent release layer 5.
Figure 3:
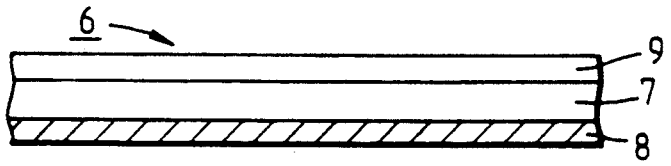
FIG. 3 is a schematic, fragmentary elevation (not to scale) of a compatible TTP donor sheet 6 comprising a polymeric substrate 7 having on one surface (the front surface) thereof a transfer layer 8 comprising a sublimable dye in a resin binder, and on a second surface (the rear surface) thereof a polymeric protective layer 9.
Figure 4:
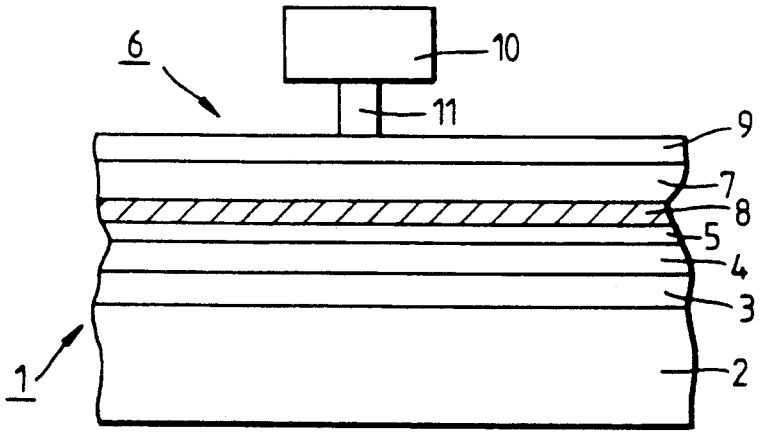
FIG. 4 is a schematic elevation of a TTP process.
Figure 5:
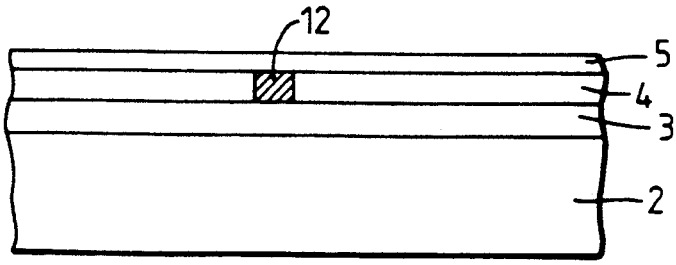
FIG. 5 is a schematic elevation of an imaged receiver sheet.

Referring to the drawings, and in particular to FIG. 4, a TTP process is effected by assembling a donor sheet and a receiver sheet with the respective transfer layer 8 and release layer 5 in contact. An electrically-activated thermally print-head 10 comprising a plurality of print elements 11 (only one of which is shown) is then placed in contact with the protective layer of the donor sheet. Energisation of the print-head causes selected individual print-elements 11 to become hot, thereby causing dye from the underlying region of the transfer layer to sublime through dye-permeable release layer 5 and into receiving layer 4 where it forms an image 12 of the heated element(s). The resultant imaged receiver sheet, separated from the donor sheet, is illustrated in FIG. 5 of the drawings.

By advancing the donor sheet relative to the receiver sheet, and repeating the process, a multi-colour image of the desired form may be generated in the receiving layer.

The invention is further illustrated by reference to the following Examples.

EXAMPLE 1

This is a comparative Example, not according to the invention.

Polyethylene terephthalate containing 18% by weight, based on the weight of the polymer, of a finely-divided particulate barium sulphate filler having an average particle size of 0.5 μm was melt extruded through a film-forming die onto a water-cooled rotating, quenching drum to yield an amorphous cast composite extrudate. The cast extrudate was heated to a temperature of about 80° C. and then stretched longitudinally at a forward draw ratio of 3.2:1.

The longitudinally stretched film was then heated to a temperature of about 96° C. and stretched transversely in a stenter oven at a draw ratio of 3.4:1. The stretched film was finally heat-set under dimensional restraint in a stenter oven at a temperature of about 225° C.

The resultant sheet comprised an opaque, voided substrate layer of filled polyethylene terephthalate of about 125 μm thickness.

The substrate layer was coated on one side with a 5% by weight solution in chloroform of an unfilled copolyester of 65 mole % ethylene terephthalate and 35 mole % of ethylene isophthalate. The coated receiving layer was dried in an oven at 120° C. for 30 seconds. The thickness of the dried receiving layer was 3 μm.

The printing characteristics of the receiver sheet were assessed using a donor sheet comprising a biaxially oriented polyethylene terephthalate substrate of about 6 μm thickness having on one surface thereof a transfer layer of about 2 μm thickness comprising a magenta dye in a cellulosic resin binder.

A sandwich comprising, a sample of the donor and receiver sheets with the respective transfer and receiving layers in contact was placed on the rubber covered drum of a thermal transfer printing machine and contacted with a print head comprising a linear array of pixcels spaced apart at a linear density of 6/mm. On selectively heating the pixcels in accordance with a pattern information signal to a temperature of about 350° C. (power supply 0.32 watt/pixcel) for a period of 10 milliseconds (ms), magenta dye was transferred from the transfer layer of the donor sheet to form a corresponding image of the heated pixcels in the receiving layer of the receiver sheet.

After stripping the transfer sheet from the receiver sheet, the band image on the latter was assessed under an optical microscope for any small printing flaws, on a scale from 0 (=poor quality i.e. a large number of flaws) to 5 (=excellent i.e. effectively no flaws).

The printed receiving layer contained a large number of printing flaws, i.e. scored 0.

The Deformation Index (measured as hereinbefore described (200° C.; 2.0 megapascals) of the opaque, voided, oriented and heat-set single substrate layer of the barium sulphate-filled polyethylene terephthalate prepared by the aforementioned procedure was 3.0%.

EXAMPLE 2

This is a comparative Example, not according to the invention.

The procedure of Example 1 was repeated save that the substrate layer was formed from a polyethylene terephthalate composition devoid of barium sulphate and containing instead, 10% by weight of a propylene homopolymer and 1% by weight of pigmentary titanium dioxide.

The printed receiving layer contained printing flaws, reduced in number compared to Example 1, i.e. scored 3.

The Deformation Index of the single, oriented and heat-set substrate layer was 18%.

EXAMPLE 3

The procedure of Example 1 was repeated except that separate streams of a first polymer (for forming the substrate layer) formed from a polyethylene terephthalate composition containing 10% by weight of a propylene homopolymer and 1% by weight of pigmentary titanium dioxide, and a second polymer (for forming the intermediate layer) formed from a polyethylene terephthalate composition containing 18% by weight, based on the weight of the polymer, of a finely-divided particulate barium sulphate filler having an average particle size of 0.5 μm, were supplied from separate extruders to a single-channel coextrusion assembly. The resultant sheet comprised a substrate layer of 130 μm thickness and an intermediate layer of 10 μm thickness. The free surface of the intermediate layer, remote from the substrate layer was coated with a receiving layer, as described in Example 1.

The printed receiving layer was observed to be almost free from printing flaws, both regularly and irregularly spaced flaws, i.e. scored 5.

The Deformation Index of the single, oriented and heat-set substrate layer was 18%.

EXAMPLE 4

The procedure of Example 3 was repeated except that a second intermediate layer was formed on the substrate layer, i.e. forming an intermediate layer/substrate layer/intermediate layer composite sheet. The thickness of the substrate layers was 109 μm and the thickness of both the intermediate layers was 16 μm. A receiving layer was coated on top of the free surface of one of the intermediate layers, as described in Example 3.

The printed receiving layer was observed to be almost free from printing flaws, both regularly and irregularly spaced flaws, i.e. scored 5.

EXAMPLE 5

The procedure of Example 4 was repeated except that the thickness of the substrate layer was 125 μm, and the thickness of the first intermediate layer was 1-2 μm and the thickness of the second intermediate layer was 25 μm. The receiving layer was formed on the free surface of both intermediate layers.

The printed receiving layer formed on the first intermediate layer was observed to be almost free from printing flaws, both regularly and irregularly spaced flaws, i.e. scored 5.

The printed receiving layer formed on the second intermediate layer contained a few printing flaws, i.e. scored 4.

The receiver sheets produced in Examples 3, 4 and 5 all exhibited high gloss, opacity and whiteness, with a significant reduction in the presence of both regularly and irregularly spaced printing flaws, compared to comparative Examples 1 and 2.

We claim:

1. A thermal transfer printing receiver sheet for use in association with a compatible donor sheet, the receiver sheet comprising a supporting substrate having, on a surface thereof, a polymeric intermediate layer having on the remote surface thereof, a dye-receptive receiving layer to receive a dye thermally transferred from the donor sheet, wherein the substrate comprises a layer of a synthetic polymer having a polymeric softening agent dispersed therein, said substrate having a deformation index, at a temperature of 200° C. and under a pressure of 2 megaPascals, of at least 4.5% and the intermediate layer is opaque, said intermediate layer containing an effective amount of a voiding agent selected from the group consisting of an incompatible resin filler and a particulate inorganic filler.

2. A receiver sheet according to claim 1 wherein the deformation index of the substrate layer is from 10 to 30%.

3. A receiver sheet according to claim 1 wherein the softening agent comprises an olefine polymer.

4. A receiver sheet according to claim 3 wherein the substrate comprises a dispersing agent.

5. A receiver sheet according to claim 1 wherein the filler comprises barium sulphate.

6. A receiver sheet according to claim 1 wherein the thickness of the intermediate layer does not exceed 50 μm.

7. A method of producing a thermal transfer printing receiver sheet for use in association with a compatible donor sheet, comprising forming a supporting substrate and providing on a surface thereof, a polymeric intermediate layer having on the remote surface thereof, a dye-receptive receiving layer to receive a dye thermally transferred from the donor sheet, wherein the substrate comprises a layer of a synthetic polymer having a polymeric softening agent dispersed therein, said substrate having a deformation index, at a temperature of 200° C. and under a pressure of 2 megaPascals, of at least 4.5%, and the intermediate layer is opaque and contains an effective amount of a voiding agent selected from the group consisting of an incompatible resin filler and a particulate inorganic filler.

8. A method according to claim 7 wherein the substrate and intermediate layer are formed by coextrusion.

* * * * *